US010381024B2

(12) United States Patent
Tan et al.

(10) Patent No.: US 10,381,024 B2
(45) Date of Patent: Aug. 13, 2019

(54) METHOD AND APPARATUS FOR VOICE ACTIVITY DETECTION

(71) Applicant: MOTOROLA SOLUTIONS, INC, Chicago, IL (US)

(72) Inventors: Cheah Heng Tan, Bayan Lepas (MY); Thean Hai Ooi, Batu Maung (MY); Wei Qing Ong, Segamat (MY); Alan Wee Chiat Tan, Taman Jati (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 261 days.

(21) Appl. No.: 15/498,560

(22) Filed: Apr. 27, 2017

(65) Prior Publication Data

US 2018/0315443 A1 Nov. 1, 2018

(51) Int. Cl.

| | |
|---|---|
| ***G10L 25/84*** | (2013.01) |
| *G10L 25/18* | (2013.01) |
| *G10L 25/78* | (2013.01) |
| *G10L 25/03* | (2013.01) |

(52) U.S. Cl.

CPC ..... *G10L 25/84* (2013.01); *G10L 25/03* (2013.01); *G10L 25/18* (2013.01); *G10L 2025/786* (2013.01)

(58) Field of Classification Search

None

See application file for complete search history.

(56) References Cited

PUBLICATIONS

Aneeja , G et al.; Single Frequency Filtering Approach for Discriminating Speech and Nonspeech;EEE/ACM transactions on audio, speech, and language processing. 23(4):705-717 (Year: 2015).*

V. Hohmann; Frequency analysis and synthesis using a Gammatone filterbank; Acta Acustica united with Acustica, vol. 88,& nbsp;No. 3, May/Jun. 2002, pp. 433-442(10) (Year: 2002).*

B. Sklar; Digital Communications Fundamental and Applications; 1988 Prentice Hall; p. 389 (Year: 1988).*

Cooper, Douglas, "Speech Detection Using Gammatone Features and One-class Support Vector Machine" (2013). Electronic Theses and Dissertations. 2714. http://stars.library.ucf.edu/etd/2714.

(Continued)

*Primary Examiner* — Abul K Azad

(74) *Attorney, Agent, or Firm* — Barbara R. Doutre

(57) ABSTRACT

A voice activity detection system (100) filters audio input frames (102), on a frame=by-frame basis through a gammatone filterbank (104) to generate filtered gammatone output signals (106). A signal energy calculator (108) takes the filtered gammatone output signals and generates a plurality of energy envelopes. Weighting factors are constructed (112) are applied to each of the energy envelopes thereby producing normalized weighted signal (116), in which voice regions are emphasized and noise regions are minimized. An entropy measurement (118) is taken to extract information from the normalized weighted signals (116) and generate an entropy signal (120). The entropy signal (120) is averaged and compared to an adaptive entropy threshold (122), indicative of a noise floor. Decision logic (124) is used to identifying speech and noise from the comparison of the averaged entropy signal to the adaptive entropy threshold.

19 Claims, 3 Drawing Sheets

(56) References Cited

PUBLICATIONS

Jun Qi, et al.: "Auditory features based on Gammatone filters for robust speech recognition", Circuits and Systems (ISCAS), 2013 IEEE International Symposium, May 19-23, 2013, all pages.
Shen, J. et al.: "Robust Entropy-Based Endpoint Detection for Speech Recognition in Noisy Environments", ICSLP, 1998, pdfs.semanticscholar.org, all pages.

* cited by examiner

METHOD AND APPARATUS FOR VOICE ACTIVITY DETECTION

FIELD OF THE INVENTION

The present invention relates generally to audio communication devices and more particularly to a method and apparatus for voice activity detection.

BACKGROUND

Portable battery-powered communication devices are advantageous in many environments, but particularly in public safety environments such as fire rescue, first responder, and mission critical environments, where voice command operations may take place under noisy conditions. The digital radio space is particularly important for growing public safety markets such as Digital Mobile Radio (DMR), APCO25, and police digital trunking (PDT), to name a few. Accurate speech recognition of verbal commands spoken into radios and/or accessories can be critical to overall communication.

Existing voice detection approaches may suffer from false triggering, a condition in which noise is detected as speech or vice versa. A major challenge for automatic speech recognition (ASR) relates to significant performance reduction in noisy conditions, as current techniques tend to be less robust when operating in very low signal to noise (SNR) environments.

Accordingly, there is a need for an improved method and apparatus for voice activity detection. Portable communication devices, such as handheld radios and associated accessories, such as VOX enabled devices, as well as vehicular communication devices would benefit greatly from improved voice activity detection for voice command operations. It would be a further benefit if the improved voice activity detection could be applied to operations such as noise suppression, echo cancellation, automatic gain control, and other voice processing operations.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
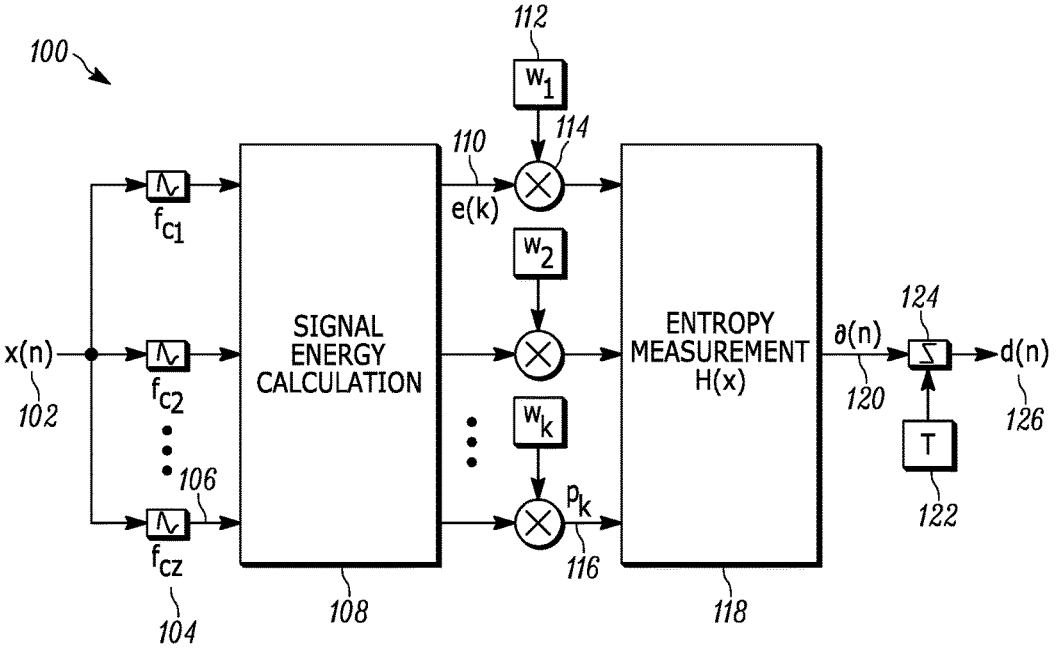
FIG. 1 is a functional block diagram for voice activity detection in accordance with the embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is described herein a robust method and apparatus to distinguish voice and non-voice in an audio signal input to a communication device. In accordance with the embodiments, a voice activity detection system, method and communication device provide processing of the audio signal, containing voice mixed with noise, through two main stages, the first stage providing gammatone filtering through a gammatone filter bank, and the second stage providing entropy measurement. Operationally, the voice activity detection system captures the audio signal for processing through the gammatone filter stage which discriminates speech and non speech regions of the input audio signal. The detected speech regions are further enhanced with weighting factors applied prior to entropy measurement. Entropy measurement is made and an entropy signal is generated. A voice activity decision is made using an adaptive entropy threshold and logic decision. A communication device having a voice command feature is thus better able to identify a predetermined speech command within a noisy environment.

FIG. 1 is a functional block diagram of a voice activity detection system 100 formed and operating in accordance with the embodiments. Operationally, the audio signal x(n) 102, containing voice mixed with noise, is input on a frame by frame basis through a gammatone filter bank 104, operating in the frequency domain. The gammatone filter bank 104 provides a plurality of bandpass filters for filtering out predetermined frequencies within audio frequency ranges 104 each having respective center frequencies fc1, fc2, to . . . fcz, also referred to as frequency channels, thereby producing a gammatone filtered output signal 106 for each audio frame.

The gammatone filterbank 104, operating in the frequency domain, extracts frequency-sensitive information for temporal frequency presentation. The gammatone filterbank simulates motion of a basilar membrane of a cochlea in a human auditory system by splitting an input signal into subsequent frequency bands as done by the biological cochlea. The gammatone filterbank 104 filters centre frequencies ($f_c$) which are distributed across frequency in proportion to their bandwidth, known as an equivalent rectangular bandwidth (ERB) scale provided by, $$\mathrm{ERB}=24.7(4.37*10^{-3}f_c+1)$$

where, $f_c$=central frequency of the filter (in Hz).

A mathematical representation in the form of an impulse response in time domain, g(t), is provided by:

$$g(t)=at^{n-1}e^{-2\pi bt}\cos(2\pi f_c t+\phi)$$

where, $f_c$=central frequency of the filter (in Hz), $\phi$=phase of the carrier (in radians), a=amplitude (controls gain), n=order of the filter, b=bandwidth (also known as bark scale) related to the center frequency, $f_c$, by 1.019*ERB, thus $$b=1.019*24.7(4.37*10^{-3}f_c+1).$$

In accordance with the embodiments, the plurality of bandpass filters of gammatone filterbank 104 are cascaded in parallel to cover the plurality of frequency channels, wherein each filter of the filterbank will filter an incoming audio frame to produce a gammatone filtered output signal 106 containing speech characteristics falling within the frequency band of that respective filter. Every audio frame is filtered through all of the plurality of filters, thereby generating the plurality of gammatone-filtered output signals 106 for each audio frame.

In accordance with the embodiments, the gammatone-filtered output signal 106 contains elements which are processed through an energy signal calculator 108 to calculate an energy envelope, e(k), for each frame. Each energy envelope e(k) 110 is calculated at the energy signal calculator 108 by taking the absolute value of each element of the gammatone-filtered output signal 106 for each audio frame m(k), where k-=1, 2, . . . N frames.

In accordance with the embodiments, each calculated energy envelope e(k) 110 has a weighting factor w(k) 112 applied thereto to emphasize voice and compensate for noise. Each weighting factor w(k) 112 is constructed based on a mean determined for the lowest energy levels within each frame m(k). Thus, each weighting factor corresponds to a noise floor in each respective spectral band. The mean of a lowest predetermined percentage of the energy levels for each frame m(k) is used to determine each weighting factor 112 within each frequency channel by:

$$w(k) = \frac{1/m(k)}{\sum_{k=1}^{N} 1/m(k)}$$

where:

w(k) represents the weighting factor;

N represents the number of frames; and m(k) represents the mean of a lowest predetermined percentage of energy levels for each frame.

For example, the mean of the lowest 20 percent of the energy levels for each frame m(k) may be used to determine each weighting factor w(k). Thus, in accordance with the embodiments, the weighting components are non-fixed weighting components. Each energy envelope e(k) 110 and its respective weighting factor w(k) 112 are multiplied by respective multipliers 114 to generate a normalized weighted signal p(k) 116 provided by:

$$p_k = e(k) * w(k)$$

where, e(k) represents energy envelope e(k), and w(k) represents weighting factor.

The normalized weighted signal $p_k$ is substituted into an entropy formula, H(x), across frequency at entropy measurement stage 118 to measure the amount of information at each time instant as provided by:

$$H(x) = -\sum_{k=0}^{K-1} p_k \log_2 p_k$$

where:

H(x) represents entropy, p(k) represents the normalized weighted signal, k represents k-th frame with k=0, 1, . . . , K−1 frame; and K represents the total number of frames of the gammatone filtered and emphasized signal.

The entropy measurement H(x) taken at each frequency channel generates an entropy output, ∂(n) 120.

For the purposes of this application, H(x) is used as a general equation for entropy measurement with the use of 'x' for indexing, wherein 'x' can generally be used for any kind of system, whether continuous or time-sampled, while ∂(n) is used to represent a time-sampled digital system, and thus the use of 'n' as the index.

In accordance with the embodiments, the entropy measurement, H(x), provides high precision measuring of the amount of information within a frequency channel, particularly for signals below 0 dB of a signal to noise ratio (SNR). In other words, the signal to noise ratio (SNR) of the noise floor in each respective spectral band is negative. Thus, the entropy measurement 118 is advantageously able to highlight the contrast between speech and non-speech regions thereby increasing the robustness of the voice activity detection system 100.

In accordance with the embodiments, the entropy output ∂(n) 120 is used to compute an adaptive entropy threshold (T) 122 by adding the mean of entropy ∂(n) and a predetermined variance over a predetermined time window. For example, adding the mean of entropy ∂(n) to three times the variance of the lowest 20 percent of entropy for the predetermined time window (t) can provide for an adaptive entropy threshold (T) 122.

In accordance with the embodiments, the entropy signal ∂(n) 120 is also averaged over the predetermined time window (t), and compared to the adaptive threshold (T) 122. For example, each element of the entropy ∂(n) may be averaged over a predetermined time window of t=300 ms, and compared to an adaptive threshold that may be T=0.05 for that time window. In accordance with the embodiments, decision logic 124 is applied to provide a voice activity detection decision d(n) 126 of logic 1 or logic 0, based on:

$$d(n)=1, \text{ if averaged } \partial(n)>T$$

$$d(n)=0, \text{ if averaged } \partial(n)\leq T$$

where:

d(n) represents the voice activity detection decision, averaged ∂(n) represents the mean of the entropy for the predetermined time window (t);

logic 1 represents a speech region, logic 0 represents a noise region, and

T represents an adaptive entropy threshold of entropy for the predetermined time window (t).

In accordance with the embodiments, the voice activation system 100 of FIG. 1 advantageously overcomes false triggering problems (false triggering being a false speech indication) by extracting robust speech features under degraded signal conditions, rather than attempting to construct speech or construct a noise model as done in past linear scale approaches to voice detection. Robustness is beneficially provided by system 100 through the use of the gammatone filter bank 104 which provides the ability to simulate the human auditory system and filter the input signal 102 into subsequent frequency channels to cascade with the entropy measurement 118 for frequency sensitive information extraction. The use of weighting factors 112 to emphasize the energy envelopes e(k) enhances the ability of the entropy measurement 118 to achieve higher precision in measuring the amount of information within a frequency channel, particularly for signals below 0 dB of signal to noise ratio (SNR) to highlight the contrast between speech and non-speech regions thereby increasing the robustness of the voice activity detection system 100. The gammatone filter 104 is an asymmetric filter causing the non-fixed weighting factors with the benefit of being able to change with time to track the changing noise floor.

As an example, the word "SPEECH" being received as signal 102 may be divided into two frames where "SP" is first filtered by the gammatone filter bank 104, operating in the frequency domain, and "EECH" is filtered immediately right after it. Accordingly, the "SP" frame is filtered first through each filter of the filterbank 104, followed by the "EECH" frame being subsequently filtered through each filter of the filterbank 104. The two frames entering the filterbank 104 thus become divided into frequency channels for distinguishing if "SP" is voice or noise and for distinguishing if "EECH" is voice or noise. The dividing of the frames into frequency channels occurs in response to each gammatone filter within the filter bank 104 having a different passband with different center frequency, wherein there may be overlap between some of the passbands.

In accordance with the embodiments, signal energies of the filtered gammatone output signals 106 are calculated at the energy signal calculator 108 to generate energy envelopes e(k) indicative of voice. Thus, for the "SPEECH" example, a plurality of energy envelopes are produced by the calculation 108 for the filtered "SP" frame across the frequency channels, and another plurality of energy envelopes are produced by the calculation 108 for the filtered "EECH" frame across the frequency channels.

For the "SPEECH" example, weighting factors w(k) 112 may be constructed by taking the mean of a lowest predetermined percentage of the energy levels for each frame m(k) within each frequency channel. For example, the mean of the lowest 20 percent of the energy levels for each frame m(k) may be used to determine each weighting factor w(k).

For the "SPEECH" example, the weighting factors w(k) are applied, via the multipliers 114, to each of the energy envelopes e(k) 110 associated with a frame. Hence, each of the plurality of energy envelopes e(k) 110 associated with the filtered "SP" frame across the channels will have a respective weighting signal applied thereto via multiplier 114. Similarly, each of the plurality of energy envelopes e(k) 110 associated with the filtered "EECH" frame across the channels will also have a respective weighting signal applied thereto via respective multiplier 114. Hence, each energy envelope e(k) 110 and its respective weighting factor w(k) 112 are multiplied by respective multipliers 114 to generate a normalized weighted signal p(k) 116 for each frame "SP" and "EECH" across the channels.

The normalized weighted signals 116 are measured by entropy measurement H(x) 118 to generate an entropy signal ∂(n) 120 averaged over the predetermined time window. Thresholding of the entropy signal ∂(n) 120 over the time window results in logic ones and zeroes (1), (0) with logic 1 indicating speech and logic 0 indicating noise.

So for example: for averaged ∂(n)=0.03 and T=0.05 over a timeframe=300 ms, then d(n)=1, if averaged ∂(n)>T, for T=0.05 over 300 ms and d(n)=0, if averaged ∂(n)≤T.

Voice activity detection system 100 may be operated in a voice command enabled device, for example within a VOX capable accessory providing hands-free user interaction. The gammatone filtering in the frequency domain provided by the embodiments advantageously avoids time-consuming FFT computations associated with some prior voice activity detection approaches.

Figure 2:
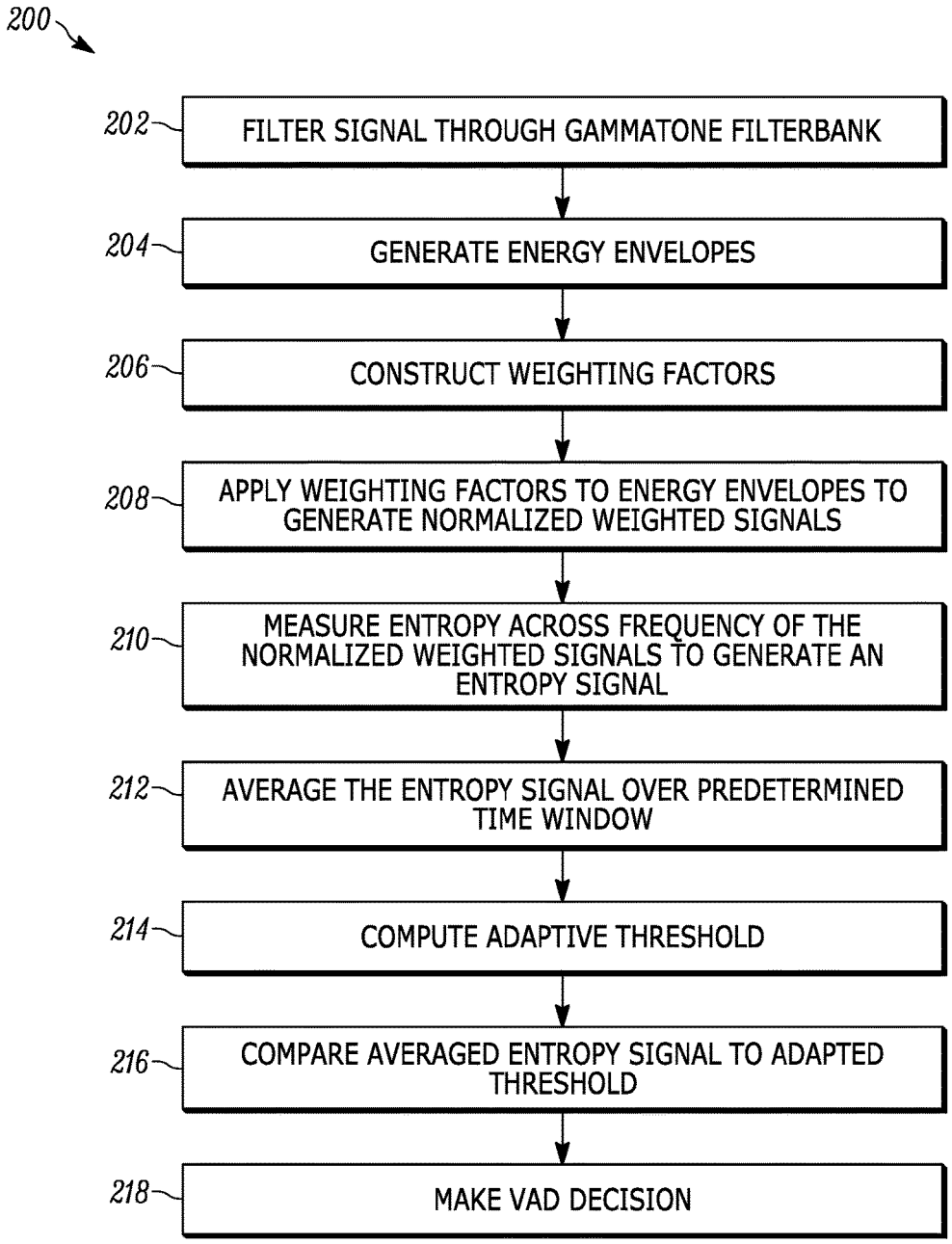
FIG. 2 is a flowchart of a method for voice activity detection in accordance with the embodiments.

FIG. 2 is a flowchart of a method 200 in accordance with some embodiments. The method 200 may be operated in a voice command enabled device, or some other device, in which speech needs to be differentiated from noise. Method 200 begins at 202 by filtering an audio signal input through a gammatone filterbank. The gammatone filterbank, as described previously, comprises a plurality of cascaded bandpass filters covering an audio frequency range and where the plurality of filters filter incoming audio frames to generate filtered gammatone signals over a plurality of frequency channels. Signal energies are calculated for each of the filtered gammatone signals to generate a plurality of energy envelopes at 204.

Weighting factors are constructed for each of the energy envelopes at 206 and applied to the energy envelopes at 208, via respective multipliers previously described, thereby generating normalized weighted signals.

By measuring entropy for the normalized weighted signals across frequency, a single entropy signal, ∂(n), is generated at 210. The entropy signal is averaged over a predetermined window of time at 212, and an adaptive entropy threshold is computed at 214, in the manner previously described. The averaged entropy signal is compared to the computed adaptive threshold computed at 216. A voice activation decision is made at 218, by using decision logic associated with the computed adaptive threshold over the predetermined time window as previously described.

Accordingly, the method 200 provides voice activity detection decision based on decision logic in which the averaged entropy signal is compared to an adaptive entropy threshold to indicate speech activity, for example with a logic "1", and indicate noise activity, for example with a logic "0".

Figure 3:
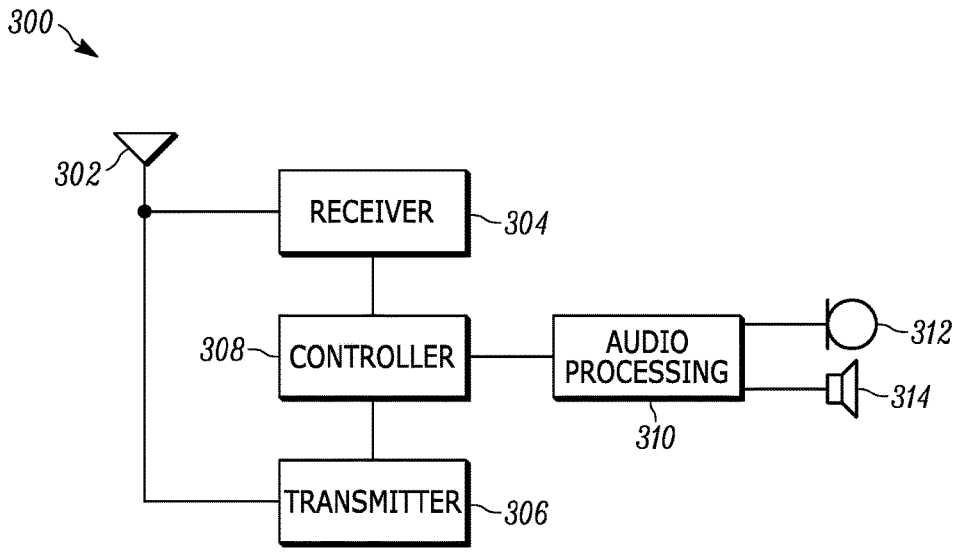
FIG. 3 is a block diagram of a communication device providing voice activity detection formed and operating in accordance with the embodiments.

FIG. 3 is a block diagram of a communication device formed and operating in accordance with some embodiments. The communication device 300 may be a voice command enabled device, or some other device, in which speech needs to be differentiated from noise. Communication device 300 may comprise for example, an antenna 302, a receiver 304, a transmitter 306, a controller 308, an audio processing stage 310, a microphone 312 and a speaker 314. In accordance with the embodiments, voice activity detection takes place within the controller's audio processing stage 310 in response to an audio input signal to the microphone 312. The audio processing stage 310 provides voice activity detection for extracting voice from noise to facilitate the recognition of voice commands. The audio processing stage 310 provides a gammatone filterbank, such as gammatone filterbank 104 of FIG. 1 for filtering audio frames 102 into filtered gammatone signals 106. The audio processing stage 310 further performs energy signal calculations, such as by energy signal calculator 108, on the filtered gammatone output signals 106 to generate energy envelopes 110. The audio processing stage 310 further constructs and applies weighting factors 112 to the energy envelopes 110 thereby generating normalized weighted signals 116 in which voice regions are emphasized and noise regions are minimized. The audio processing stage 310 further performs entropy measurements 118 of the normalized weighted signals 116 over frequency to generate a single entropy signal 120. The audio processing stage 310 computes the adaptive entropy threshold (T) 122 by adding the mean of the entropy signal ∂(n) and a predetermined variance over a predetermined time window. The adaptive entropy threshold 122 is indicative of a noise floor. The audio processing stage 310 further compares the entropy ∂(n) signal averaged over the predetermined time window (t) to the adaptive threshold (T) 122 via decision logic 124 to identify speech and non-speech regions within the predetermined time window.

Examples of communication device 300 include but are not limited to narrowband two-way radio, such as portable handled two-way radio devices and two-way radio vehicular radio device, as well as handsfree type devices such as a VOX capable devices providing hands-free user interaction, and further applicable to broadband type devices such as cell phones and tablets having audio processing capability, and combination devices providing land mobile radio (LMR) capability over broadband.

The method and apparatus are interoperable with different systems such as APCO25, Digital Mobile Radio (DMR), Terrestrial Trunked Radio (Tetra) and Police Digital Trunking (PDT) communication standards. Unlike past systems that model noise characteristics or use prior known frequencies or a single frequency, the apparatus, method and communication device embodiments which uses gammatone filtering and entropy to extract speech characteristics advantageously allows the speech to survive, even in a corrupted signal, without the need for prior data. The filtering of the embodiments is performed without any form of prior training of ambient noise environments. Furthermore, the use of the entropy measurement and logic decision advantageously negates the need for mean and standard deviation calculations associated with past single frequency filtering approaches. The embodiments have also negated the use of Fast Fourier Transform (FFT) calculations for the entropies, which provides the advantage of reduced processing. The reduced processing provided by the voice activity detection of the embodiments may also be beneficially applied to other voice related audio processing approaches such as noise suppression, echo cancellation, ans automatic gain control, to name a few.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A voice activity detection system, comprising:

a gammatone filterbank operating in the frequency domain, the gammatone filter bank filtering a plurality of audio frames on a frame-by-frame basis to generate a plurality of gammatone filtered output signals within a plurality of frequency channels, an energy signal calculator for converting the plurality of gammatone-filtered output signals into a plurality of energy envelopes, each energy envelope being calculated for each audio frame;

a plurality of multipliers for applying a plurality of weighting factors to the plurality of energy envelopes thereby generating a plurality of normalized weighted signals;

an entropy measurement stage for extracting information from the normalized weighted signals and generating an entropy output signal; and decision logic determining speech and non-speech regions based on a comparison between an averaged entropy output signal to an adaptive entropy threshold.

2. The voice activity system of claim 1, wherein each energy envelope is calculated by taking an absolute value of each element of the filtered gammatone signal for each audio frame.

3. The voice activity detection system of claim 1, wherein the plurality of weighting factors are non-fixed weighting factors calculated for each frequency channel by averaging over the plurality of audio frames.

4. The voice activity detection system of claim 1, wherein each of the plurality of weighting factors is constructed based on a mean of a lowest predetermined percentage of energy levels for each energy envelope of each audio frame.

5. The voice activity detection system of claim 1 wherein the entropy measurement provides high precision measuring of an amount of information within a frequency channel for signals below 0 dB of signal to noise ratio (SNR).

6. The voice activity system of claim 1, wherein the adaptive entropy threshold is generated by adding a mean of the entropy output signal and a predetermined variance over a predetermined time window.

7. A method for voice activity detection, comprising:

filtering an audio input signal on a frame-by-frame basis through a gammatone filterbank, operating in the frequency domain, to generate gammatone filtered output signals over a plurality of frequency channels;

generating a plurality of energy envelopes from the gammatone filtered output signals, each energy envelope being calculated for each audio frame;

constructing a plurality of weighting factors for each of the plurality of energy envelopes;

applying each of the plurality of weighting factors, via a plurality of respective multipliers, to each of the plurality of energy envelopes, thereby generating a plurality of normalized weighted signals;

measuring entropy across frequency for the plurality of normalized weighted signals over a predetermined time window to generate an entropy signal;

averaging the entropy signal over the predetermined time window;

computing an adaptive threshold;

comparing the averaged entropy signal to the adaptive threshold; and applying decision logic to the comparison to indicate speech activity and indicate noise activity.

8. The method of claim 7, wherein the filtering of the audio input signal on a frame-by-frame basis is performed without any form of prior training of ambient noise environments.

9. The method of claim 7, wherein each energy envelope of the plurality of energy envelopes is calculated by taking an absolute value of each element of the gammatone-filtered output signal for each audio frame m(k), where k−=1, 2, . . . N audio frames.

10. The method of claim 9, wherein each of the plurality of weighting factors is determined by:

$$w(k) = \frac{1/m(k)}{\sum_{k=1}^{N} 1/m(k)}$$

where:

w(k) represents the weighting factor;

N represents the number of audio frames; and m(k) represents the mean of a lowest predetermined percentage of energy levels for each audio frame.

11. The method of claim 10, wherein each of the plurality of normalized weighted signals is determined by:

$$pk=e(k)*w(k)$$

where:

p(k) represents a normalized weighted signal;

e(k) represents an energy envelope ; and w(k) represents the weighting factor associated with each respective energy envelope.

12. The method of claim 10, wherein the entropy is measured by:

$$H(x) = -\sum_{k=0}^{K-1} p_k \log_2 p_k$$

where:

H(x) represents entropy;

p(k) represents the normalized weighted signal;

k represents k-th frame with k=0,1, . . . , K−1 frame; and

K represents total number of frames of the gammatone filtered and emphasized signal.

13. The method of claim 11, wherein each element of the entropy signal is averaged over a predetermined time window (t) and decision logic is applied to provide a voice activity detection decision d(n) of logic 1 or logic 0, based on:

d(n)=1, if averaged ∂(n)>T d(n)=0, if averaged ∂(n)<T where:

d(n) represents the voice activity detection decision;

0 represents the logic 0;

1 represents the logic 1;

averaged ∂(n) represents average entropy over a predetermined time window; and

T represents an entropy threshold.

14. The method of claim 7, wherein the gammatone filter is an asymmetric filter causing the weighting factors to change with time to track a changing noise floor.

15. The method of claim 7, wherein the gammatone filterbank simulates characteristics of a human auditory system.

16. The method of claim 7, wherein the method is performed without the use of Fast Fourier Transform (FFT) calculations.

17. A communication device, comprising:

a controller providing an audio processing stage for detecting voice activity and determining, based on the voice activity, that the audio signal is a voice command through a voice activity detection apparatus, comprising:

a gammatone filterbank, operating in a frequency domain, for filtering audio frame inputs into filtered gammatone output signals; and a signal energy calculator performing energy signal calculations on the filtered gammatone output signals to generate a plurality of energy envelopes, each energy envelope being calculated for each audio frame;

a plurality of multipliers for applying a respective weighting factor to each of the plurality of energy envelopes thereby producing a normalized weighted signal, in which voice regions are emphasized and noise regions are minimized, for each audio frame;

an entropy measurement stage for measuring and extracting information from the normalized weighted signals;

an adaptive entropy threshold for comparing the extracted information to a noise floor; and decision logic for identifying speech and noise from the comparison.

18. The communication device of claim 17, wherein the communication device comprises one of: voice activated radio, a voice activated accessory for a radio, a vehicular radio.

19. The communication device of claim 17, wherein each respective weighting factor is constructed based on a mean determined for the lowest energy within each audio frame.

* * * * *